United States Patent [19]

Lai

[11] Patent Number: 4,988,833

[45] Date of Patent: Jan. 29, 1991

[54] RETRACTABLE COILED ELECTRICAL CABLE

[75] Inventor: Vu A. Lai, Austin, Tex.

[73] Assignee: W. L. Gore & Associates, Inc., Newark, Del.

[21] Appl. No.: 400,260

[22] Filed: Aug. 29, 1989

[51] Int. Cl.[5] ..... H01B 7/06
[52] U.S. Cl. ..... 174/69
[58] Field of Search ..... 174/69

[56] References Cited

FOREIGN PATENT DOCUMENTS 1164898 5/1958 France ..... 174/69
847383 9/1960 United Kingdom ..... 174/69

*Primary Examiner*—Laramie E. Askin
*Attorney, Agent, or Firm*—Gary A. Samuels

[57] ABSTRACT

A retractable coiled cable having a retractable member imbedded in the jacket of the coiled cable so as to utilize space between adjacent coil turns of the coiled cable, allowing the adjacent coil turns of the coiled cable to fit together with no increase in diameter over that of a coiled cable having no retractable member.

11 Claims, 2 Drawing Sheets

RETRACTABLE COILED ELECTRICAL CABLE

FIELD OF THE INVENTION

The present invention relates to coiled cables which if stretched will retract into a coil when released. The coiled cables are used for wiring, moving parts of robots, automated machinery, jointed apparatus, and electronic equipment.

BACKGROUND OF THE INVENTION

The invention is particularly useful when an existing coiled cable cannot meet the retraction requirements without increasing the outer diameter of the coil by adding high retraction components inside the cable itself.

The invention is also very useful in applications requiring high shielding effectiveness which cannot be met by commonly used shielding methods in coiled cables, such as those devised by Takebe, in U.S. Pat. No. 4,683,349. The invention will allow additional shielding material to be added without degrading the retraction ability of the coiled cable.

In addition, the invention is useful in applications where materials needed for the conditions of the operating environment have poor retraction characteristics, therefore, not meeting the retraction requirements.

Several methods have been used to achieve retractable coiled electrical cables. Many forms of retractable coiled cables rely upon a jacket surrounding the wires of the cable which may be heat-set in coil form while the cable is in coiled configuration. Such methods are typically found in U.S. Pat. No. 3,993,860 to Snow, et al., U.S. Pat. No. 3,318,994 to Perrone, et al.,, U.S. Pat. No. 3,324,229 to Ingamson, U.S. Pat. No. 3,694,279 to Rohrig, et al. and U.S. Pat. No. 2,609,417 to Cox, et al.

Shielded cables are also known where a strength member or a drain wire is included inside the shield of the cable, such as in U.S. Pat. No. 3,278,329 to Timmons; however, inclusion of a strength member or drain wire within the shield usually leads to a larger diameter cable and requires more material to make it.

A conductor is spiralled around an insulated electrical conductor, such as devised by Takebe, in U.S. Pat. No. 4,683,349. The spiralled outer conductor provides shielding around the center conductor when the cable is in coil form, or not stretched, but leaves wide gaps in the shielding, which greatly reduces the effectiveness of the shield, when the cable is extended or stretched. Metal strips have been imbedded within the insulation of a cable in a longitudinal manner so that the springy strips would coil the cable into a flat coil to act as a spring to support a hanging lamp at the end of the coiled cable, as shown in U.S. Pat. No. 3,042,742, to Foster. The spring strips did not provide significant shielding coverage of the center conductor so as to be useful for a coaxial cable for electronic signals.

SUMMARY OF THE INVENTION

The present invention comprises a coiled cable which has retraction components imbedded in the jacket of the coiled cable outside a shield of the coiled cable in such a manner that there is minimal profile or thickness added to the coiled cable. Placement of the retractable component outside the electrical shield of the coiled cable in the manner of the invention allows the coiled cable to be made as small as can be made considering the desired electrical properties of the coiled cable wanted for its intended use, which may include very small coiled cables useful in robots, electronic equipment, or the like where small size can be extremely advantageous. Any coaxial or round cable can be utilized to form the coiled cable invention. The round cable may be one or more fiber optic cables alone or one or more electrical cables alone or combination of one or more fiber optic cables together with coaxial or other electrical cables, and may even include a tube.

The round or coaxial cable may be jacketed in any one of the polymeric jacketing materials knonw to be useful for jacketing cable, such as for example, polyvinyl chloride, plyurethane, silicone rubber, elastomeric polyester, or other thermoplastic polymers and rubber, fluorinated elastomers, such as fluorinated ethylene-propylene copolymers (FEP), perfluoroalkoxy tetrafluoroethylene (PFA), copolymers of ethylene and tetrafloroethylene, porous expanded polytetrafluoroethylene and polytetrafluoroethylene, polyethylene, and polypropylene. A preferred insulation material for both the jacketing and for the insulation between the center conductor and shield of a coaxial cable or as insulation on wires within a round cable used as a part of the invention is porous expanded ploytetrafluoroethylene. This material and methods for making it are described in U.S. Pat. Nos. 3,953,566, 4,187,390, 3,962,153, and 4,096,227, assigned to W. L. Gore & Associates, Inc.

Retractable members imbedded within the coiled cable may be of nylon polyamide material or metals, such as beryllium-copper alloys. There may be one or two retractable members in the coiled cable, depending upon how strong a retractive property is desired for a particular coiled cable and how large or how strong each retractable member is desired to be, and upon the overall size and strength constraints of a particular embodiment of the coiled cable. The retractable members may also vary in size as well as in retraction strength.

The invention thus provides a way to make very small round or coaxial cables into or coiled cable which has a cable outside diameter no larger than that of a coiled cable not having retractable means. No compromise to the electrical shielding properties is necessary to achieve this desirable smaller size and a new lower limit to the size can be achieved to make it useful in a desired application.

DESCRIPTION OF THE PREFERRED EMBODIMENTS

Figure 1:
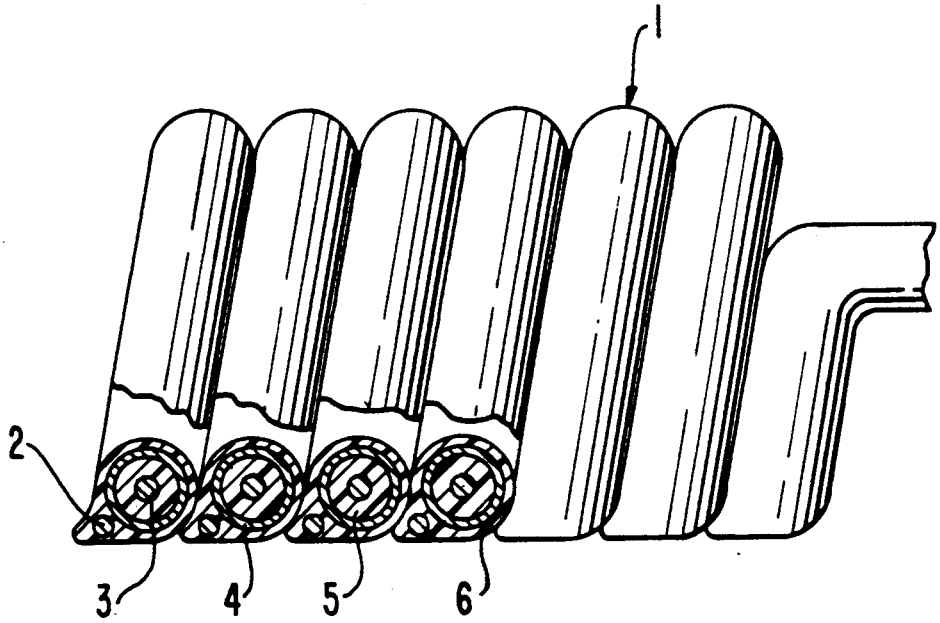
FIG. 1 is a view including a partial cut away cross-section of coil turns of a coiled, of the invention.

Referring now to the drawings to more clearly describe and completely delineate the invention, FIG. 1 shows a few coil turns of the coil 1 of the invention with several coil turns of the coiled cable depicted in cross-section. The retractable members 2 are formed in a bead of insulation 6 on the outside of shield 4 of cable 1.

Cable 1 includes a standard coaxial electrical cable having center conductor 3 surrounded by insulation 5 and a conductive shield 4. In cable 1, center conductor 3 is placed at about a 45° angle to retractable member 2 when cable 1 is coiled around a centerline, such as that formed by a mandrel or a rod, so as to utilize the space between adjacent coil turns of a cable wound around a center for supplying physical space to house retractable members 2 without requiring the thickness of cable 1 to be larger than that needed if no retractable members 2 are present.

Figure 2:
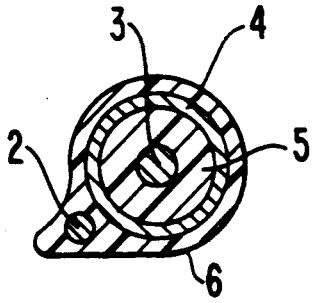
FIGS. 2 and 3 are cross-sectional views of a coiled cable of the invention including one or two retractable members.
Figure 3:
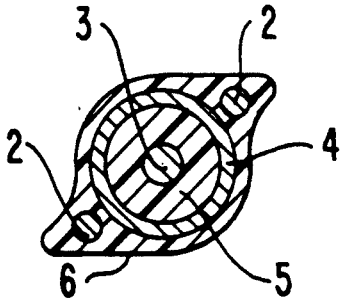
Figure 4:
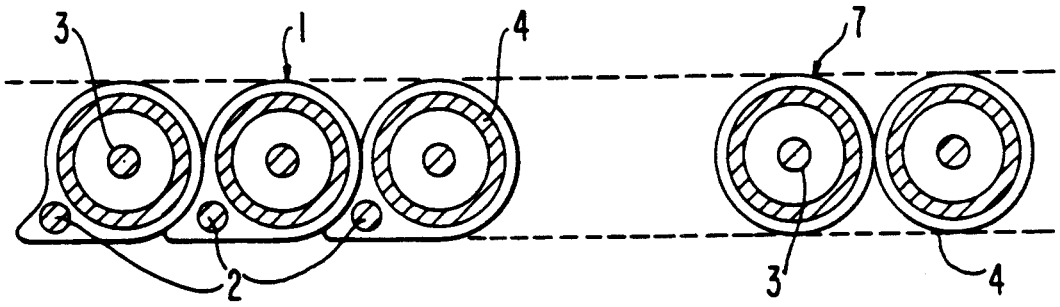
FIG. 4 is a view comparing the cable size of a coiled cable of the invention with that of a similar coiled cable having no retractable members.

FIGS. 2 and 3 are cross-sectional representations of cable 1 having one or two retractable members 2. FIG. 4 depicts clearly in cross-section how segments of adjacent coil turns of cable 1 fit together with no increase in diameter over standard coil turns of coiled cable 7 having no retractable members 2.

Figure 5:
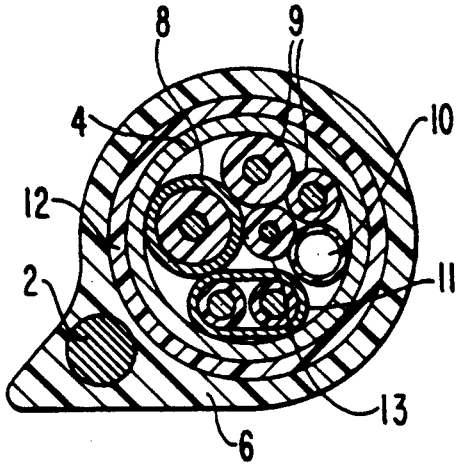
FIG. 5 is a cross-sectional view of a coiled cable of the invention including a round cable which contains several kinds of cables and a tube.

FIG. 5 illustrates a cross-section of a round cable useful in the invention which in this example includes a retraction member 2, an outer jacket 6, and a round cable which is formed with an outer insulation jacket 12 and a conductive shield 4. The round cable contains or houses two insulated conductors 9, a coaxial electric cable 8, a hollow plastic tube 10, a shielded twisted pair of insulated conductors 11, and a fiber optic cable 13 which are exemplary items often contained within a round cable. Other wires, cable, and the like known in the art to be housed within a round cable may be substituted for those exemplified. Fiber optic cables may be bundled together to form a round cable or may be included with other kinds of cables within a round cable. A typical individual fiber optic cable may be a fiber component that can be a single (single mode) or more than one clad fiber (multi mode) of various nylon or other polymer or glass materials, a mechanical support layer, and a protective jacket.

I claim:

1. A coiled cable, which when said coil is stretched will retract into a coil when released, comprising:

(a) a round cable, including at least one electrically conductive center conductor surrounded by an insulative material;

(b) an electrically conductive shield surrounding said round cable;

(c) at least one layer of electrically insulative material surrounding said shield; said round cable, said shield and said at least one layer of insulative material surrounding said shield being formed into a coil having a plurality of coil turns; said at least one layer of insulative material being shaped generally concentrically around said round cable and shield, but having a protrusion extending toward the adjacent coil turn in the spacial volume normally excluded between two adjacent coil turns: and (d) one or more elongated strands of retractable material imbedded in the protrusion of said at least one layer of insulative material.

2. A coiled cable of claim 1 wherein said retractable material comprises a configuration-settable material 3. A coiled cable of claim 2 wherein said configuration-settable material is selected from the group consisting of an organic polymer and a metal alloy.

4. A coiled cable of claim 3 wherein said configuration-settable material is an organic polymer and said organic polymer is a polyamide material.

5. A coiled cable of claim 3 wherein said configuration-settable material is a metal alloy and said metal alloy is a beryllium-copper alloy.

6. A coiled cable of claim 1 wherein said round cable and said electrically conductive shield comprise a coaxial electric cable.

7. A coiled cable of claim 1 wherein said round cable comprises a multiplicity of cables.

8. A coiled cable of claims 1, 2, 4, 5, 6, or 7 wherein said insulative material surrounding said center conductor comprises porous expanded polytetrafluoroethylene.

9. A coiled cable of claims 1, 2, 4, 5, 6, or 7 wherein said insulative material surrounding said shield comprises a thermoplastic organic polymer.

10. A coiled cable of claims 1, 2, 4, 5, 6, or 7 wherein said insulative material surrounding said shield comprises porous expanded polytetrafluoroethylene.

11. A coiled cable, which when said coil is stretched will retract into a coil when released, comprising:

(a) a round electrical cable;

(b) an electrically conductive shield surrounding said round electrical cable:

(c) at least one layer of electrically insulative material surrounding said shield; said round electrical cable, said shield and said at least one layer of insulative material surrounding said shield being formed into a coil having a plurality of coil turns; and (d) one or more strands of retractable material imbedded in said at least one layer of insulative material surrounding said round electrical cable and positioned within said at least one layer of insulative material adjacent said round electrical cable such that said retractable material lies generally within the volume between the coil turns along the outer diameter of said coiled cable; said at least one layer of insulative material being shaped generally concentrically around said round electrical cable and said shield, but having a protrusion, in which said one or more strands of retractable material are imbedded, extending toward the adjacent coil turn in the spacial volume normally excluded between two adjacent coil turns.

* * * * *